US005238536A

United States Patent [19]

Danby

[11] Patent Number: 5,238,536

[45] Date of Patent: Aug. 24, 1993

[54] MULTILAYER FORMING FABRIC

[75] Inventor: Roger Danby, Arnprior, Canada

[73] Assignee: Huyck Licensco, Inc., Wake Forest, N.C.

[21] Appl. No.: 721,249

[22] Filed: Jun. 26, 1991

[51] Int. Cl.[5] ..... D21F 11/00

[52] U.S. Cl. ..... 162/202; 162/903

[58] Field of Search ..... 162/202, 348, 903; 139/383 A

[56] References Cited

U.S. PATENT DOCUMENTS

| | | | |
|---|---|---|---|
| 4,515,853 | 5/1985 | Borel | 162/DIG. 1 |
| 4,554,953 | 11/1985 | Borel | 162/DIG. 1 |
| 4,705,601 | 11/1987 | Chiu | 162/348 |
| 4,759,391 | 7/1988 | Waldvogel et al. | 62/348 |
| 4,759,976 | 7/1988 | Dutt | 162/348 |
| 5,066,532 | 11/1991 | Gaisser | 162/DIG. 1 |

OTHER PUBLICATIONS

*Pulp & Paper Canada* 87:8, Roger Danby, pp. 69–74, (1986).

*Pulp & Paper Canada* 90:2, Roger Danby, pp. T45–T50, (1989).

*Primary Examiner*—W. Gary Jones
*Assistant Examiner*—Brenda Lamb
*Attorney, Agent, or Firm*—Lorusso & Loud

[57] ABSTRACT

A triple layer papermaking fabric having top and bottom fabric layers joined by a binder yarn, the top fabric layer including machine direction and cross machine direction yarns interwoven in a plain weave having an open area determined by the formula:

$$(1-N_c \times D_c) \times (1-N_m \times D_m) \times 100$$

where $N_c$ = number of Cross Machine Direction yarns per inch $N_m$ = number of Machine Direction yarns per inch $D_c$ = number of Cross Machine Direction yarns $D_m$ = diameter of Machine Direction yarns The configuration of the papermaking fabric reduces or eliminates density differences in the finished paper sheet produced on it.

5 Claims, 4 Drawing Sheets

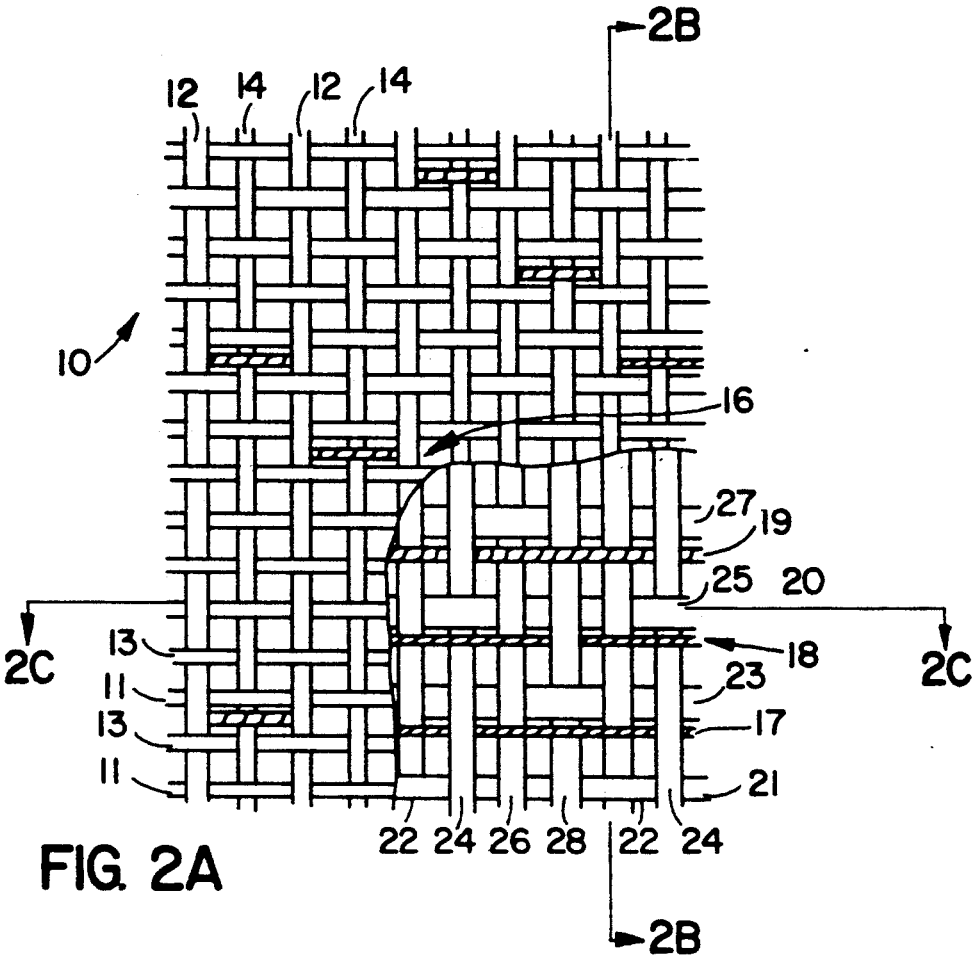
FIG. 2A
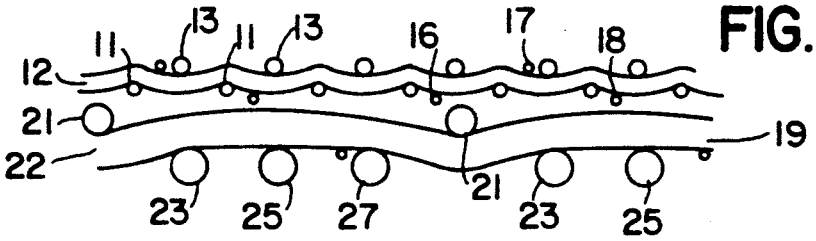
FIG. 2B
FIG. 2C
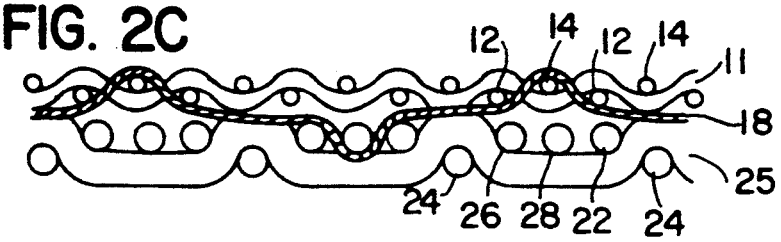

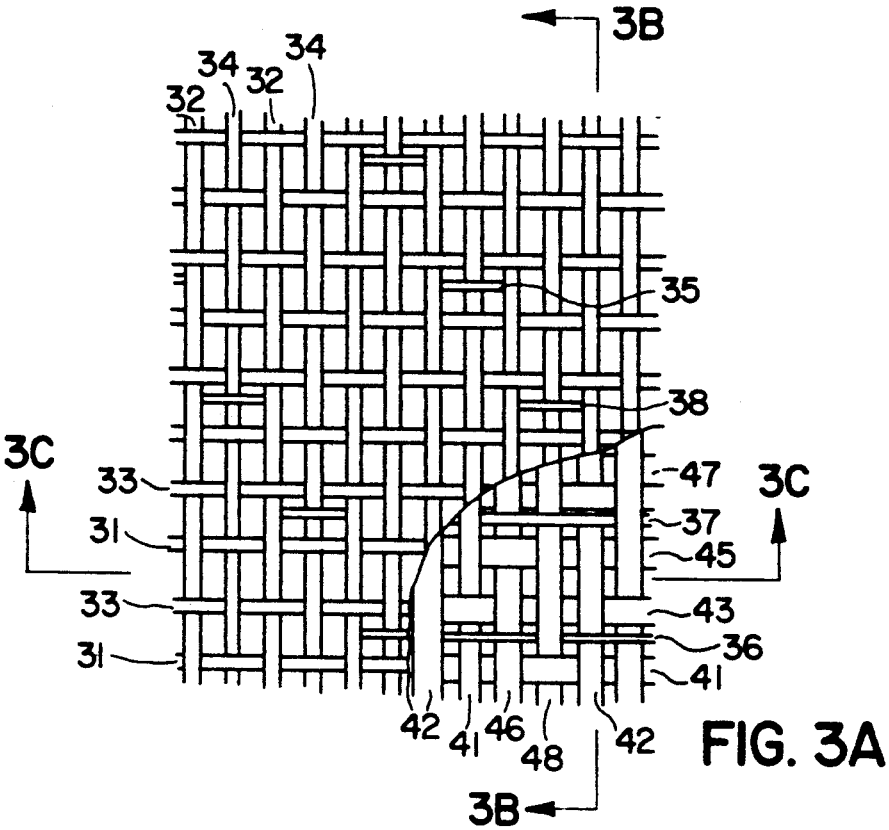
FIG. 3A
FIG. 3B
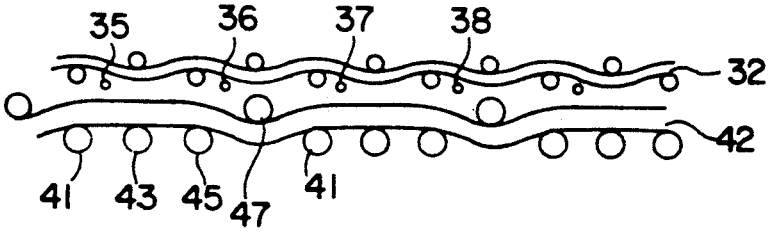
FIG. 3C
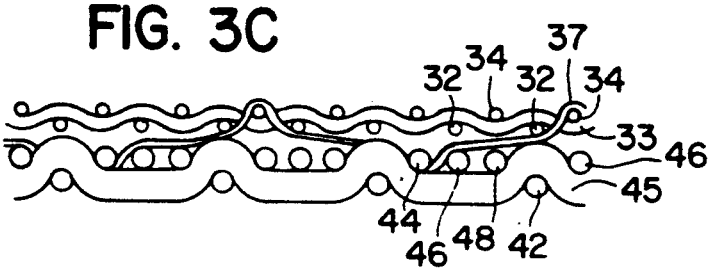

MULTILAYER FORMING FABRIC

BACKGROUND OF THE INVENTION

This invention relates to papermakers' fabrics and especially to papermaking fabrics for the forming section of a papermaking machine.

In the conventional papermaking process, a water slurry or suspension of cellulose fibers, known as the paper "stock", is fed onto the top of the upper run of a traveling endless forming belt. The forming belt provides a papermaking surface and operates as a filter to separate the cellulosic fibers from the aqueous medium to form a wet paper web. In forming the paper web, the forming belt serves as a filter element to separate the aqueous medium from the cellulosic fibers by providing for the drainage of the aqueous medium through its mesh openings, also known as drainage holes, by vacuum means or the like located on the drainage side of the fabric.

After leaving the forming medium, the somewhat self-supporting paper web is transferred to the press section of the machine and onto a press felt, where still more of its water content is removed by passing it through a series of pressure nips formed by cooperating press rolls, these press rolls serving to compact the web as well.

Subsequently, the paper web is transferred to a dryer section where it is passed about and held in heat transfer relation with a series of heated, generally cylindrical rolls to remove still further amounts of water therefrom.

Over the years, papermakers have sought improvements in the forming fabric, not only with respect to the operating life of the fabric, but also with respect to the quality of the paper sheet produced on it. Triple layer fabrics were introduced for this purpose. The triple layer fabric has two generally distinct surfaces. The top surface is one integral fabric structure designed specifically for papermaking to achieve the best possible sheet quality and machine efficiency. This top fabric is manufactured as an integral part of a woven structure with a completely separate bottom fabric designed specifically for mechanical stability and fabric life. The purpose of triple layer fabric development is to eliminate the compromises which exist with both single and double layer forming fabrics so that papermakers can produce the best possible paper sheet for top quality at reduced cost without sacrificing the wear characteristics of the papermaking fabric.

The paper produced on the papermaking machine is described in part with relation to its formation and wire mark. Formation is most commonly described as the difference in density of a sheet of paper when looking through the sheet. The ideal formation is a sheet which has completely uniform density. Sheets with areas of varying density are said to be flocky or cloudy. The word formation is generally used to describe macro scale areas of varying density which can be easily seen by the human eye. Headbox design and performance have the most effect on large scale formation. This, together with the turbulence created by stationary elements, principally dictates the final large scale sheet formation. Wire mark, on the other hand, is used to explain the micro or finer levels of density difference, often caused by the structure of the forming fabric on which the sheet was produced.

The initial fiber mat formed on a papermaking fabric, which becomes the paper sheet, is very greatly influenced by the surface structure of the filtering medium on which it settles. It follows that a fine, uniform support grid will give a more uniform initial fiber mat than a coarse non-uniform support grid. This degree of uniformity in fact influences subsequent layers of fiber as the sheet is formed, and eventually, the paper sheet produced.

The papermaking fabric is essentially a filter by which the cellulose fibers, of varying lengths, are separated from the water component of the paper stock. A completely closed fabric, or 100 percent closed fabric, would have no drainage and would therefore be unworkable. The fabric must be opened from this maximum, to create an orifice effect to allow drainage. A forming fabric which is 100% open is also no good as it will not retain fibers from the stock solution to form a sheet. Opening the fabric, additionally, often accomplished by reducing the diameter of the yarns used to weave the fabric, creates density differences.

The effect of differences in density of the paper sheet, whether caused by large scale flock or finer scale wire mark, is to vary the degree to which ink penetrates the paper sheet. FIG. 1 illustrates the way in which this phenomenon is caused. FIG. IA illustrates that when a sheet is being formed on an open forming medium, the sheet will be made up of thick areas over the holes and thin areas over the knuckles. In FIG. 1B, during pressing and calendering, the thick areas are compressed more than the thin areas, which results in a sheet having differences in density. The paper of the resulting sheet, as shown in FIG. 1C, will have a high gloss, be very smooth and have low porosity in the areas of high density. These areas, when printed, will have low ink penetration which will result in a print in this areas which will have high gloss and possibly high offset. On the other hand, the areas of the sheet over the knuckles will have low density, low gloss, be rougher and have higher porosity. When printed, these areas will have greater ink penetration, which will result in a matt finish compared to the dense areas over the holes of the fabric, and with the high porosity, print strike through may occur to the opposite side of the sheet. Whether differences in density of the sheet are caused by large scale flock or fine scale wire mark, the effect on the final print quality of high and low gloss through variation in ink penetration is the same. Terms used to describe these effects are "galvanizing" or "mottle".

The type and pattern of wire mark that will be produced by any fabric can be easily shown by taking a surface impression of the papermaking surface of the fabric It has been found that the high knuckles of a fabric, around which the stock slurry flows and settles lower down in the fabric body, leave light areas. The degree of wire mark that hits the eye, therefore, is determined by the frequency and continuity of the pattern formed by the knuckles of the fabric. Openness of the fabric will, of course, affect these density variations and the surface impression.

For example, a coarse single layer fabric has low frequency, and each hole formed by the knuckle will therefore show up more than when compared to the higher frequency of the finer mesh. Further, if the wire mark pattern is a straight twill line, as compared to a broken satin, it will strike the eye to an even greater extent. The degree of differences in density of a sheet caused by wire mark, therefore, can be said to be affected by the frequency, or number of knuckles/square inch, and the continuity and coarseness of the pattern.

At the present time, there is a great need for a paper sheet with more uniform formation, and equal printing properties on both sides for every printing grade. It has been found that the micro density differences of the paper sheet, resulting from the knuckles of the yarns on the forming fabric, are the main cause of the problem. The perfect print is one where all the ink applied absorbs into the sheet at the same rate. To date, surfaces are far from uniform, as explained above, thus leading to differences in contact and absorption of ink depending on whether it lands on a light area over a knuckle or a heavy area over a hole. When the ink hits a particular area over a knuckle, it penetrates the sheet very easily, and if the volume is sufficient, will strike through to the other side. To achieve the best print, the printer has to modify his printing conditions to strike a balance between the two extremes.

It has been found that the key to the reduction, or elimination, of these printing problems can be achieved by careful selection of the papermaking fabric upon which a paper sheet is to be produced.

It is therefore an object of the present invention to prepare a papermaking fabric that produces a paper sheet of superior print quality.

Another object of the present invention is to provide a papermaking fabric that combines good drainage capability with an optimal paper sheet surface.

It is another object of the present invention to provide a papermaking fabric in which density differences are minimized in order to optimize the printing properties of the paper sheet formed thereon.

A further object of the present invention is to provide a papermaking fabric with good wear life and abrasion resistance that produces a paper sheet with optimal printing properties.

A further object of the present invention is to provide a method for making a paper sheet having minimal density differences.

It is a further object of the present invention to provide a papermaking fabric which relates its drainage orifice dimensions to the average length of the fibers to be used to form the sheet of paper.

Still another object of the present invention is to relate drainage orifice dimensions to average fiber length in order to control the degree of retention of fibers.

SUMMARY OF THE INVENTION

To reduce and/or eliminate the problem of density differences in a paper sheet when these differences are related to the knuckles of the forming fabric, a novel triple layer fabric is provided herein. The triple layer papermaking fabric of the present invention includes a top fabric layer of a plain weave of interwoven machine direction yarns and cross machine direction yarns having an open area selected to maximize initial fiber retention and control the rate of water passage for that purpose as well, according to the following formula:

$$(1-N_c \times D_c) \times (1-N_m \times D_m) \times 100$$

where $N_c$=number of CMD yarns per inch $N_m$=number of MD yarns per inch $D_c$ and $D_m$ are corresponding yarn diameters.

The invention is further illustrated with reference to the following detailed description of the invention, and to the figures, in which like references numbers refer to like members through the various views.

BRIEF DESCRIPTION OF THE DRAWING

FIG. 2A illustrates a top view of one embodiment of the fabric of the present invention, with a portion of the top fabric layer removed;

FIG. 2B illustrates a cross machine direction view of the fabric shown in FIG. 2A, taken along the line 2B—2B in FIG. 2A;

FIG. 2C illustrates a machine direction view of the fabric shown in FIGS. 2A and 2B, taken along the line 2C—2C in FIG. 2A;

FIG. 3A illustrates a top view of one embodiment of the fabric of the present invention, with a portion of the top fabric layer removed;

FIG. 3B illustrates a cross machine direction view of the fabric shown in FIG. 3A, taken along the line 3B—3B in FIG. 3A;

FIG. 3C illustrates a machine direction view of the fabric shown in FIGS. 3A and 3B, taken along the line 3C—3C in FIG. 3A.

DETAILED DESCRIPTION OF THE INVENTION

The present invention is a triple layer forming fabric having a top fabric layer with a superior papermaking surface and a bottom fabric layer with superior wear and abrasion resistance characteristics. The papermaking fabric of the present invention forms a more uniform paper sheet because the selection of yarn diameters, weave patterns, and number of yarns is based on the interrelationship of the following Fiber length to supporting spans between yarns.

Selection of weave pattern for optimum fiber support.

Selection of mesh together with yarn diameters to maximize support for fibers of known length.

Selection of yarn diameters together with mesh and weave pattern to give a controlled drainage rate in order to minimize sheet density differences.

Selection of yarn diameters to minimize the degree of penetration into the sheet which in turn will minimize density differences.

A sheet of paper is formed when a solution of water which contains suspended fibers is passed through a woven structure. The fibers are retained on the yarns of the woven structure while the water passes through the holes in the structure.

The number of fibers retained will be influenced by not only their length but also the distance between the yarns (support spans) of the woven structure. The rate of passage of the water through the woven structure will be influenced by the size of holes (orifices) which are formed by the yarns of the woven structure.

Figure 1:
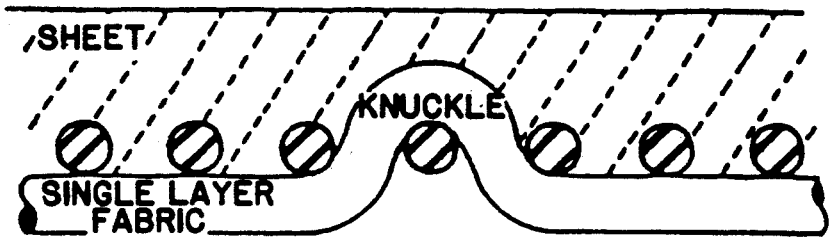
FIG. 1, including
Figure 1A:
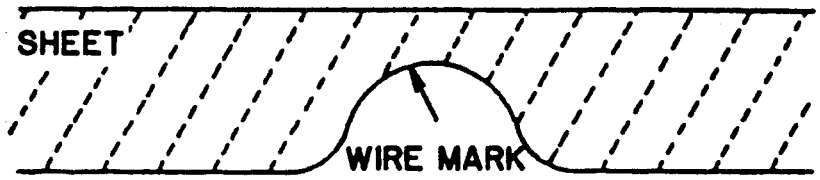
FIGS. 1A, 1B and 1C, illustrate how differences in the density of a paper sheet are formed and the effect these differences in density have on print.
Figure 1B:
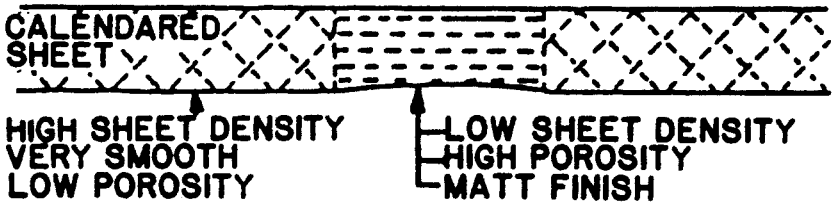
Figure 1C:
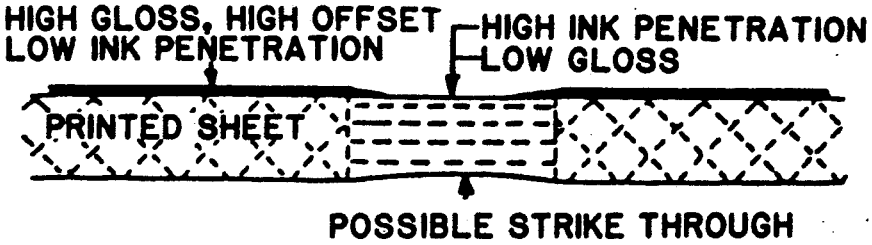

With reference to FIG. 1, it is clear that due to fiber build-up over a span between yarns, ink penetration will be light. The fiber build up over a yarn will be less, and thus ink penetration at that point will be higher. As explained above, the difference in the depth of ink penetration into the sheet is referred to as density difference in the sheet and caused by the topography of the fabric on which the sheet is formed.

Both the amount of fiber retained and the speed of drainage are very important in the process of papermaking. The other important factor is the uniformity of fiber distribution in the final sheet of paper produced, as this directly affects the rate of penetration of the printing ink into the sheet of paper. The degree and uniformity of ink penetration into the sheet directly influences the uniformity and quality of the final print.

It has been discovered that forming fabric parameters can be set in relation to the fiber lengths that are being used to produce a sheet having uniform density which when printed will have uniform print quality.

The solution to be filtered, commonly referred to as paper stock, includes generally water as the medium in which cellulosic fibers of varying lengths are suspended. The length of the fibers vary with the species of wood being used, the pulping processes and the final sheet of paper to be produced and while an average length of fiber can be found for any paper stock solution, fibers longer and shorter than that average will be present.

During the initial part of the filtering process a fiber will be separated out from the suspension to start the formation of the sheet of paper when it is forced to lay across one or more yarns that are being used to form the woven structure. The distance between these yarns (span) in relation to the length of fiber to be separated from the stock slurry will dictate how efficient the woven strucutre is in filtering out these fibers. (The closer the span and longer the fiber, the greater will be the filtering efficiency.) As soon as one fiber is caught on the support spans of the yarns, it in itself then becomes a part of the support structure and therefore forms a span across which subsequent fibers can lay. The original support span distance formed by the original fabric construction is the critical factor in dictating the length of the first fibers retained which in turn directly influences the length and pattern of subsequent fibers that are retained. A papermaking fabric, then, is chosen having a span between yarns to effectuate the most efficient initial fiber retention. The distance between spans dictates how much of the initial fibers will drop through with the water suspension and how much will be retained on the fabirc surface to form the intital part of the sheet. It has been discovered that if a greater amount of fibers are supported on the papermaking fabric, and a fewer amount drop through, a paper sheet having little or no density difference is created.

In a woven structure the distance between yarns (the span) is dictated by the woven mesh count in both directions per unit width. A typical mesh count in a plain weave structure could be expressed as "74×70 mesh". This would mean 74 yarns per unit width in one direction woven into 70 yarns per unit width in a direction at 90° to the original 74 yarns. The distance between yarns or span would then be expressed as unit width in one direction and unit width in the other direction, or 74×70.

The mesh or span distance chosen is left to those skilled in the art of selection to suit the fiber lengths that are required to be retained.

The yarns utilized in the fabric of the present invention will vary depending upon the desired properties of the final papermaking fabric, and of the paper sheet to be formed on that fabric. For example, the yarns may be multifilament yarns, monofilament yarns, twisted multifilament or monofilament yarns, spun yarns or any combination of the above. It is within the skill of those practicing in the relevant art to select a yarn type, depending on the purpose of the desired fabric, to utilize with the concepts of the present invention.

Yarn types selected for use in the fabric of the present invention may be those commonly used in papermaking fabrics. The yarns could be cotton, wool, polypropylenes, polyesters, aramids or nylon. Again, one skilled in the relevant art will select a yarn material according to the particular application of the final fabric. A commonly used yarn which can be used to great advantage in weaving fabrics in accordance with the present invention is a polyester monofilament yarn, sold by Hoechst Celanese Fiber Industries under the trademark "Trevira".

The bottom fabric layer of the papermaking fabric of the present invention may be any fabric chosen for its wear and abrasion resistance characteristics. One skilled in the relevant art can select a fabric to suit the particular needs at hand. Preferably, the bottom fabric layer will be a four or five harness sateen weave, characterized by long floats in the machine direction yarns. The preferred yarns for the bottom fabric layer of the present invention has a diameter in the machine direction of 0.20 mm and 0.25 mm for the diameter of yarns in the cross machine direction.

When fibers are carried in a water suspension they have no definite orientation, hence, when the stock slurry is being filtered to form a sheet, a fiber could fall in any direction over a yarn or a hole in the forming fabric structure. Therefore, in order to optimize the retention of fibers from the stock slurry, the fabric should be woven in a square structure having yarns in both directions evenly spaced and in a symmetrical knuckle pattern. The only weave pattern that will produce this configuration is a plain weave when yarns in both direction alternate over and under the opposite direction yarns. This weave pattern produces square holes and uniform knuckles in both directions. It is for this reason that the plain weave top surface is chosen to give the most uniform support to the fibers during filtering in order to produce the most uniform sheet of paper possible.

When yarns are woven in a plain weave pattern they produce holes, the minimum area (orifice) of which is approximately at the center line point of the yarns forming each side of the hole. In a woven structure, the total unit area of these holes can be expressed as a percentage of the whole area and can be calculated using the following formula:

$$(1-N_c\times D_c)\times(1-N_m\times D_m)\times 100$$

where $N_c$=number of CMD yarns per inch $N_m$=number of MD yarns per inch $D_c$ and $D_m$ are the corresponding diameters.

An embodiment of the fabric of the present invention is shown in FIGS. 2A–2C. FIG. 2A illustrates the top surface of the top fabric layer 10, including machine direction yarns, 11, 13, and cross machine direction yarns 12 and 14 interwoven in a plain weave structure. A portion of the top fabric layer is removed to illustrate the top surface of the bottom fabric layer 20, including machine direction yarns 21, 23, 25, 27 and 29 interwoven with cross machine direction yarns 22, 24, 26 and 28 in a sateen weave. FIG. 2B shows a view of the cross machine direction yarns, taken at line 2B—2B in FIG. 2A. FIG. 2C shown a view of the machine direction yarns taken at line 2C—2C in FIG. 2A. Binder yarns 16–19 are included in each of the figures.

An additional embodiment of the fabric of the present invention is shown in FIGS. 3A-3C. FIG. 3A illustrates the top surface of the top fabric layer 30, including machine direction yarns 31, 33 and cross machine direction yarns 32, 34 woven in a plain weave structure. A portion of the top fabric layer is removed to illustrate the top surface of the bottom fabric layer 40, including machine direction yarns 41, 43, 45, 47 and cross machine direction yarns 42, 44, 46, 48 in a 3:1 weave. FIG. 3B shows a view of the cross machine direction yarns, taken at line 3B—3B in FIG. 3A. FIG. 3C shows a view of the machine direction yarns, taken at line 3C—3C in FIG. 3A. Binder yarns 35, 36, 37 and 38 are included in the figures.

It has been discovered that the rate of water flow at constant pressure drop through any forming fabric will be directly proportional to the percentage open area of the top surface of that fabric structure. It therefore follows that, in order to pass a constant or required volume through a woven structure having a lower percentage top surface open area will require a higher force or pressure which will result in a higher velocity through the holes to achieve the same constant or required volume to pass.

The higher the velocity of the initial water passing through the holes of the forming fabric, the harder it will be to retain the initial fibers which will start the formation of the matt which will eventually be the basis of the sheet.

It therefore follows, the greater the top surface open area, the lower the pressure that is required to achieve a desired flow and the easier it will be to retain the fibers on the yarns of the fabric structure. Using the concepts of the present invention, those skilled in the art will select the open area of the top fabric to retain more of the initial fibers from the stock.

With the relationship as determined by the formula, open area as affected by the mesh or number of yarns per unit area and also by the diameter of the yarns in both directions, those skilled in the art can select an open area such that the distance span between yarns will suit the fiber length that is being used and/or such that the open area will suit the volume and rate of flow that is required.

It has been discovered that where a sheet is formed on a fabric structure it follows the topography of the top surface of that fabric structure. On looking through a sheet of paper formed on a fabric structure, density differences will be seen which follow the pattern of the fabric on which it was formed. As described earlier, the shorter the fibers that make up the sheet or the greater the span between yarns that make up the woven structure, the greater will be the density differences in the sheet corresponding to the pattern of the top surface of the fabric on which it was formed. It also follows as described earlier, the lower the top surface open area, the greater the density differences due to flow velocities passing through the fabric, drawing fiber with it.

There is yet another area which affects density differences in a final sheet and that is in the yarn volume or unit area contained in the cubic volume from the center line or orifice point to the top of the sheet. This can be best described by referring to FIG. 4 which shows a cross selection through two sheets of paper formed on three yarns of equal spacing (span) but of different diameters.

Figure 4:
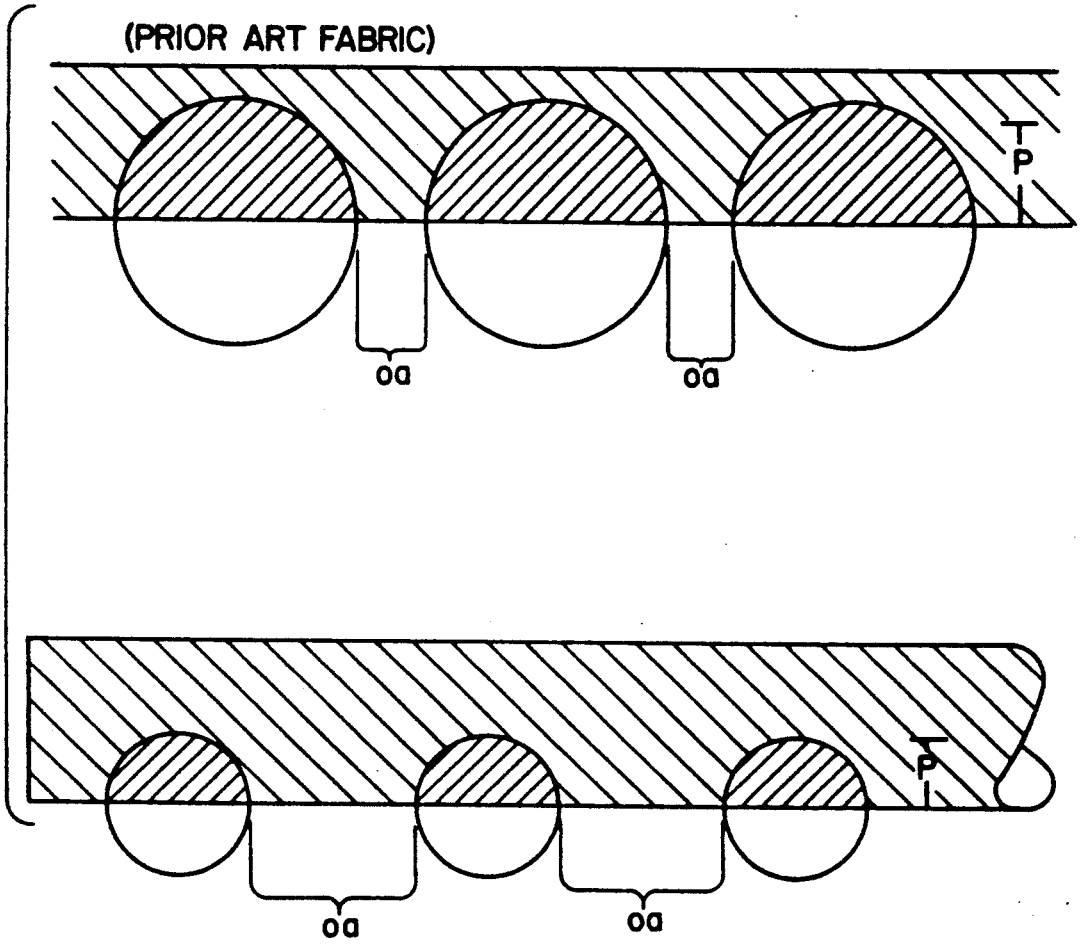
FIG. 4 is a diagrammatic representation that illustrates the effects of use of a fabric according to the present invention.

It can now be seen that as the diameter of the yarns are reduced, the differences in density will be reduced as well. Furthermore, as the diameter of the yarns decrease, two results occur, as shown in FIG. 4. A fabric with larger diameter yarns has a smaller open area "oa" between yarns, and the yarns penetrate into the paper sheet to a greater depth "p". As the yarns are reduced in diameter, the open area between them increases, and the level of penetration of each yarn into the paper sheet will decrease, thus reducing the density differences in the paper sheet created.

EXAMPLE I

A top fabric layer is prepared of a polyester monofilament yarn having a diameter of 0.13 mm in the machine direction and 0.11 mm in the cross machine direction. The mesh of the fabric is 74×70 (MD×CMD yarns). As such, using the formula above, an open area of 43.3 percent is achieved. When combined with a bottom fabric layer, a superior drainage triple layer papermaking fabric is achieved.

EXAMPLE II

A top fabric layer is prepared of a polyester monofilament yarn having a diameter of 0.13 mm in the machine direction and 0.11 mm in the cross machine direction. The mesh of the fabric will be 74×80 (MD×CMD yarns). As such, an open area of 41 percent is achieved. When combined with a bottom fabric layer, a superior drainage triple layer papermaking fabric is achieved.

With any particular paper stock, a papermaking fabric can be selected to provide optimal drainage utilizing the concepts of the present invention.

The average fiber length is determined, as with the use of an optical scanner, such as the KAJAANI FIBER LENGTH ANALYZER, available from Valmet Automation (Canada) Ltde./Ltd. of Kirkland, Quebec. Using the average fiber length, a triple layer papermaking fabric will be selected so that its top fabric layer has an open area of at least 40 percent, as determined by the formula above, and the span between yarns is approximately one third of the average fiber length. When used to filter the paper stock in the forming section of a papermaking machine, the fabric has good drainage yet provides effective support for more of the fibers in the stock, especially the initial fibers being filtered. More of the fibers filtered will be retained at the orifices.

The embodiments which have been described herein are but some of the several which utilize this invention and are set forth here by way of illustration but not of limitation. It is obvious that many other embodiments which will be readily apparent to those skilled in the art may be made without departing materially from the spirit and scope of this invention.

What is claimed is:

1. A method for producing a papersheet, said method comprising:

a) providing a paper stock of cellulosic fibers in a water slurry;

b) determining the average fiber length of the fibers in the water slurry;

c) providing a filter for the paper stock in a forming section of a papermaking machine, said filter comprising a top fabric layer and a bottom fabric layer joined by a binder yarn, said top fabric layer including interwoven machine direction yarns and cross machine direction yarns and having a percent open area calculated by the formula:

$$(1-N_c \times D_c) \times (1-N_m \times D_m) \times 100$$

'where $N_c$=number of Cross Machine Direction yarns per inch $N_m$=number of Machine Direction yarns per inch $D_c$=diameter in inches of Cross Machine Direction yarns $D_m$=diameter in inches of Machine Direction yarns and wherein the filter has a span between yarns of one third the average fiber length d) depositing the paper stock on the filter;

e) filtering the paper stock so that the fibers are retained on the filter surface to form a paper web and the water slurry goes through the filter; and f) transferring the paper web from the forming section of the papermaking machine.

2. The method of claim 1 wherein the top fabric layer is a plain weave.

3. The method of claim 1 wherein the machine direction yarns and cross machine direction yarns comprise polyester monofilament yarns.

4. The method of claim 3 wherein the top fabric layer machine direction yarns are 0.13 mm in diameter and the top fabric layer cross machine direction yarns are 0.11 mm in diameter.

5. The method of claim 4 wherein the top fabric layer machine direction yarns and top fabric layer cross machine yarns are woven in a mesh of 74×70.

* * * * *

UNITED STATES PATENT AND TRADEMARK OFFICE

CERTIFICATE OF CORRECTION

PATENT NO. : 5,238,536

DATED : August 24, 1993

INVENTOR(S) : Roger Danby

It is certified that error appears in the above-indentified patent and that said Letters Patent is hereby corrected as shown below:

Column 4, line 41, insert --factors:-- after "following";

IN THE ABSTRACT:

Line 11, replace "number" with "diameter".

Signed and Sealed this

Fifth Day of April, 1994

Bruce Lehman

*Attest:*

BRUCE LEHMAN

*Attesting Officer*

*Commissioner of Patents and Trademarks*